US008006735B2

(12) United States Patent
Collum et al.

(10) Patent No.: US 8,006,735 B2
(45) Date of Patent: Aug. 30, 2011

(54) LIFT CORD ANCHOR FOR COVERINGS FOR ARCHITECTURAL OPENINGS

(75) Inventors: Brent Collum, Red Bay, AL (US); Byron Morgan, Mooreville, MS (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 738 days.

(21) Appl. No.: 11/550,524

(22) Filed: Oct. 18, 2006

(65) Prior Publication Data

US 2007/0089839 A1 Apr. 26, 2007

Related U.S. Application Data

(60) Provisional application No. 60/728,611, filed on Oct. 20, 2005.

(51) Int. Cl.
*E06B 9/30* (2006.01)
*E06B 9/388* (2006.01)

(52) U.S. Cl. ..... 160/168.1 R; 160/173 R

(58) Field of Classification Search ..... 160/173, 160/178.1 R, 173 R; 24/115 M, 115 R, 128, 24/136 R, 130; 411/75, 76, 77, 78, 79; 403/367, 403/368

See application file for complete search history.

(56) References Cited

U.S. PATENT DOCUMENTS

| | | | | |
|---|---|---|---|---|
| 2,314,461 | A * | 3/1943 | Schaefer | 160/173 R |
| 2,887,002 | A * | 5/1959 | Mcafee | 411/49 |
| 3,404,504 | A * | 10/1968 | Taylor | 52/711 |
| 3,577,825 | A * | 5/1971 | Reusser | 411/53 |
| 5,154,558 | A * | 10/1992 | McCallion | 411/54 |
| 5,484,132 | A * | 1/1996 | George et al. | 248/231.9 |
| 5,919,542 | A * | 7/1999 | Chou | 428/99 |
| 6,718,707 | B2 * | 4/2004 | Marshall | 52/223.13 |
| 6,792,997 | B2 * | 9/2004 | Damiano | 160/178.1 R |
| 7,011,281 | B2 * | 3/2006 | Guthrie et al. | 248/231.31 |

* cited by examiner

*Primary Examiner* — Blair M Johnson
*Assistant Examiner* — Jeremy C Ramsey
(74) *Attorney, Agent, or Firm* — Dorsey & Whitney LLP

(57) ABSTRACT

An anchor for securing the lower end of lift cords to the bottom rail of a vertically retractable covering for architectural openings includes features enabling the anchor to be wedged into a blind hole formed in the top surface of the bottom rail. The anchor can be one piece or two pieces and in the event of a two-piece anchor, a main body has spreadable legs and is engaged by a cam member to spread the legs after the anchor has been inserted into the blind hole. In the case of the single-piece anchors, there are legs or fingers engageable with the side wall of the blind hole upon insertion of the anchor into the blind hole to wedgingly secure the anchor in position.

6 Claims, 9 Drawing Sheets

LIFT CORD ANCHOR FOR COVERINGS FOR ARCHITECTURAL OPENINGS

CROSS-REFERENCE TO RELATED APPLICATION

The present application claims the benefit under 35 U.S.C. §119(e) to U.S. Provisional Patent Application No. 60/728,611 ("the '611 application"), which was filed on Oct. 20, 2005 and entitled "LIFT CORD ANCHOR FOR COVERINGS FOR ARCHITECTURAL OPENINGS." The '611 application is incorporated by reference into the present application in its entirety.

BACKGROUND OF THE INVENTION

1. Field of the Invention

The present invention relates generally to retractable coverings for architectural openings and more particularly to an anchor for securing a lift cord for such a covering to the bottom rail of the covering.

2. Description of the Relevant Art

While coverings for architectural openings have assumed numerous forms for many years, most recently such coverings have been retractable in nature either vertically or horizontally across the opening depending upon the type of covering utilized. Vertically movable retractable coverings typically have a bottom rail that can be raised when moving the covering from an extended position across the architectural opening to a retracted position adjacent to the top edge of the opening. In moving the bottom rail vertically across the opening, lift cords typically extend from a control system at the top of the covering to the bottom rail and have been anchored in the bottom rail in various ways. Typically, the lift cord is passed through a hole in the bottom rail and secured beneath the bottom rail by either knotting the end of the cord so it cannot pass back through the hole or frictionally retaining the cord in the hole with a bottom cap inserted into the hole where it opens through a bottom surface of the rail.

It is to provide improvements in the manner in which a lift cord is anchored to the bottom rail that the present invention has been developed.

SUMMARY OF THE INVENTION

The present invention relates to a system for anchoring the lower end of a lift cord in a retractable covering for architectural openings in a top surface of the bottom rail rather than extending the lift cord through the rail and securing it thereto adjacent to the bottom surface of the rail.

In accordance with the present invention, a blind hole is provided in the top surface of the bottom rail and the lift cord is secured in the blind hole with an anchor that can be wedged into the wall of the hole to retain the anchor in position. It is desirable but not mandatory that the bottom rail be made of a material that is soft enough to allow the anchor to become wedged therein. The design of the wedges of the invention, however, can also be secured in a relatively firm bottom rail as will be appreciated with the detailed description that follows.

The invention is disclosed in a plurality of embodiments but in each case, the anchor is wedged into the blind hole so that the bottom surface of the bottom rail is free of any evidence of connection to the lift cord.

Other aspects, features and details of the present invention can be more completely understood by reference to the following detailed description of the preferred embodiments, taken in conjunction with the drawings and from the appended claims.

DESCRIPTION OF THE PREFERRED EMBODIMENTS

Figures 1, 2:
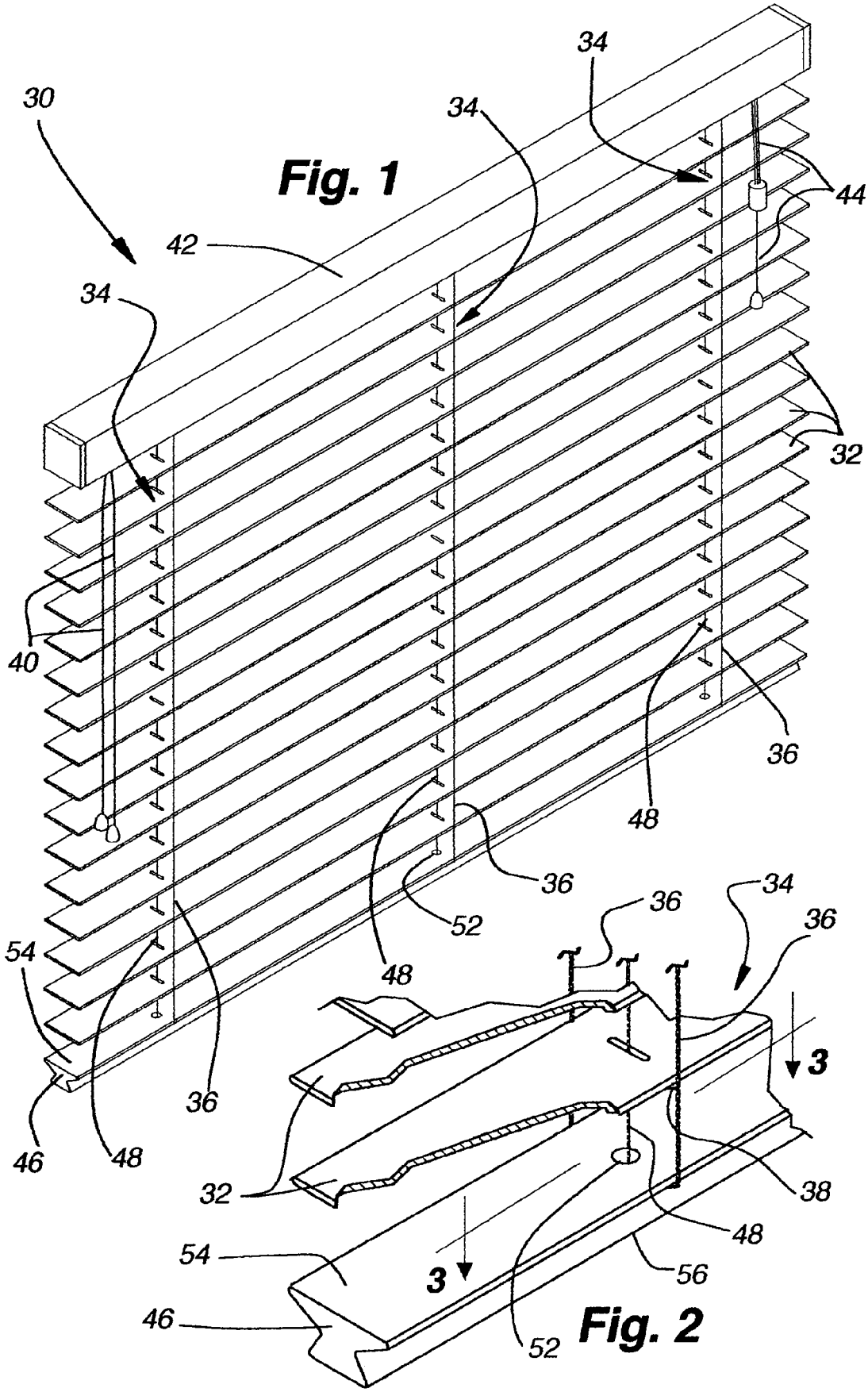
FIG. 1 is an isometric of a Venetian-blind type covering for architectural openings incorporating the anchor of the present invention for connecting the lift cords to the bottom rail.
FIG. 2 is a fragmentary enlarged isometric showing the bottom rail connected to the lift cord in accordance with the invention.
Figure 3:
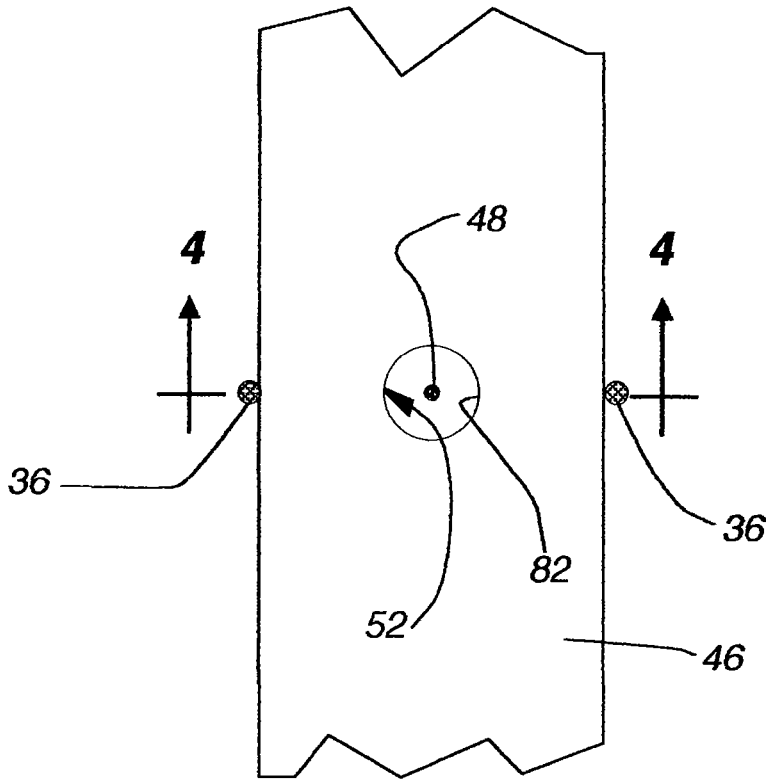
FIG. 3 is an enlarged fragmentary section taken along line 3-3 of FIG. 2.

Referring first to FIG. 1, a Venetian-blind type retractable covering 30 for architectural openings is disclosed for illustrative purposes. It will be understood from the description of the invention hereafter that its features would render it amenable to use in any type of retractable covering where the free end of a flexible element such as a lift cord is secured to a solid member such as a bottom rail.

In the Venetian blind 30 illustrated, there are a plurality of horizontally disposed parallel slats 32 supported on conventional cord ladders 34 having vertical side runs 36 extending up the front and rear edges of the slats and a plurality of support rungs 38 interconnecting the vertical runs at equally spaced intervals for support of the slats. The slats are tiltable about longitudinal axes in a conventional manner by manipulation of the front and rear vertical runs of the cord ladders so as to be movable between an open position as illustrated in FIG. 1 permitting vision and light to pass between the slats and a closed position (not shown) wherein the slats are substantially vertically oriented in overlapping relationship to occlude the passage of vision and light through the covering. Manipulation of the cord ladders is accomplished with control cords 40 which form part of a control system (not seen) disposed within a headrail 42 of the covering.

The control system also includes a lift system having control cords 44 for raising or lowering a bottom rail 46 via lift cords 48 so as to move the covering between the extended position shown in FIG. 1 and a retracted position wherein the bottom rail is positioned adjacent to the headrail 42 and the slats 32 are vertically stacked therebetween. The lift cords 48 typically have an upper end secured to a rotatable rod or spool (not seen) in the headrail so that the lift cords can be wrapped on the rod or spool through manipulation of the control cords 44 for the lift system. The bottom ends 50 of the lift cords are anchored to the bottom rail 46 with the anchor of the present invention which will be described in detail hereafter.

In a conventional Venetian blind 30 or other retractable covering having a bottom rail 46, the control system is typically adjusted so that the bottom rail rests lightly on the sill of the architectural opening where it is desirable that the bottom rail be evenly and horizontally disposed. With anchor systems that are conventional in the prior art, the lift cords typically extend through the bottom rail and are anchored to the bottom surface of the bottom rail either by knotting the bottom end of the lift cord beneath the bottom rail after the lift cord has been extended through a hole in the bottom rail, or secured to the bottom surface with a plug inserted into the open bottom end of the hole in the bottom rail. In either event, the lower surface of the bottom rail is interrupted either by a knot or the bottom plug so the rail does not rest evenly as desired.

In accordance with the present invention, the lift cords 48 are secured to the bottom rail 46 with an anchor that is inserted into a blind hole 52 provided in the top surface 54 of the bottom rail whereby the bottom surface 56 of the bottom rail is uninterrupted.

Figure 7:
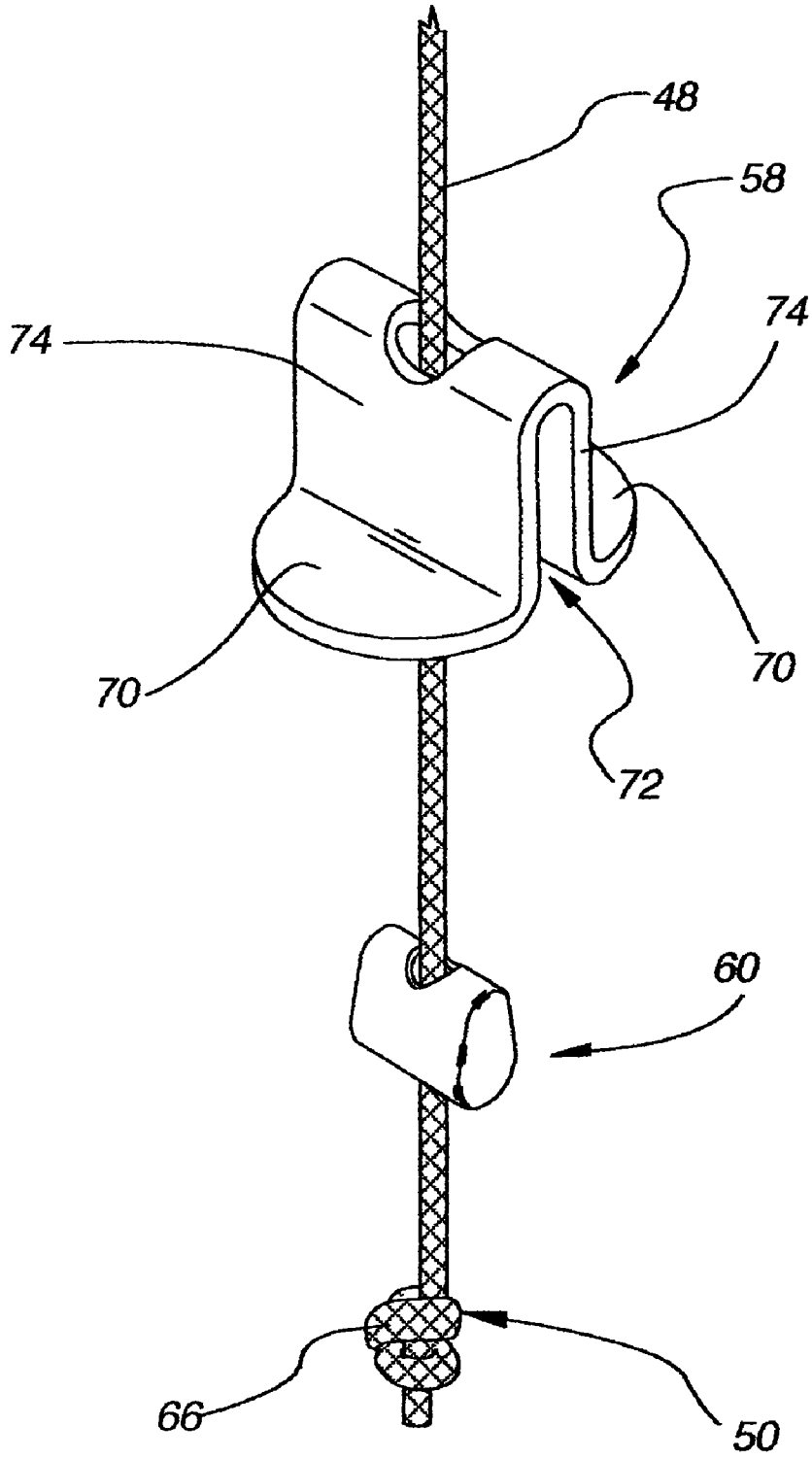
FIG. 7 is a fragmentary isometric showing the two components of the first embodiment of the invention illustrated in FIGS. 1-6 incorporated onto a lift cord and in a separated position.
Figure 9:
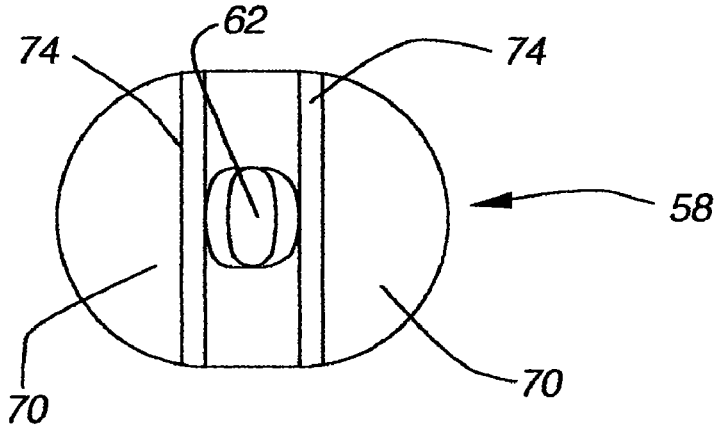
FIG. 9 is a top plan view of the base shown in FIG. 8.
Figure 8:
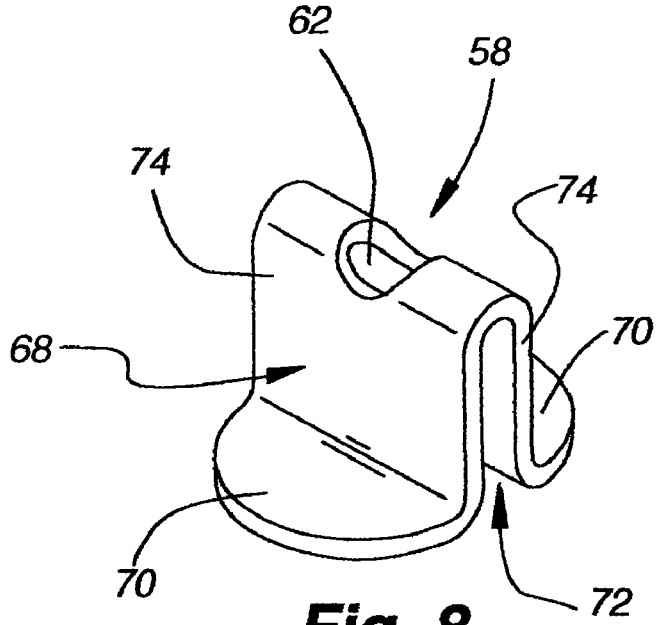
FIG. 8 is an isometric of the base for the anchor shown in FIG. 7.
Figure 10:
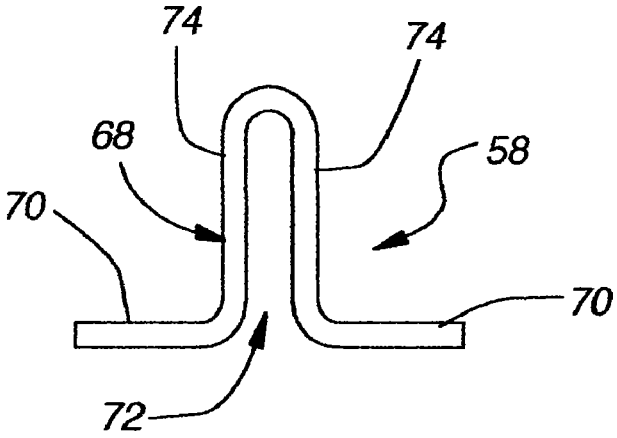
FIG. 10 is a front end elevation of the base shown in FIG. 8.
Figure 13:
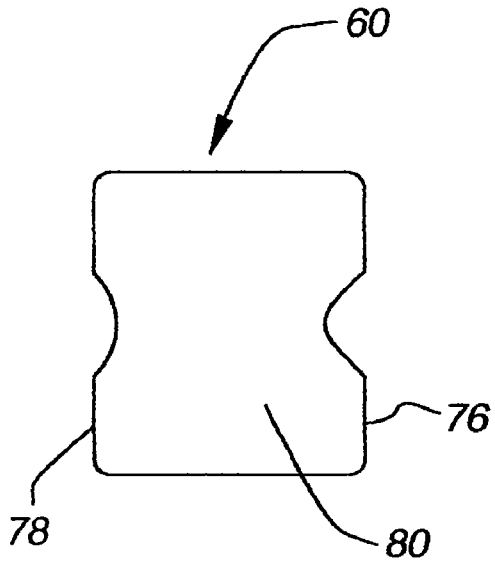
FIG. 13 is a side elevation of the cam member shown in FIG. 11.
Figure 14:
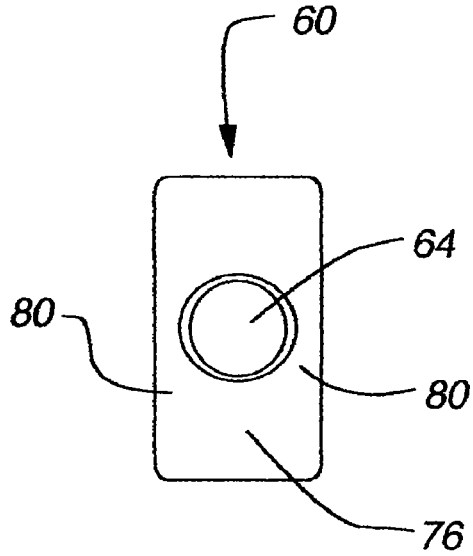
FIG. 14 is a top plan view of the cam member shown in FIG. 11.
Figure 12:
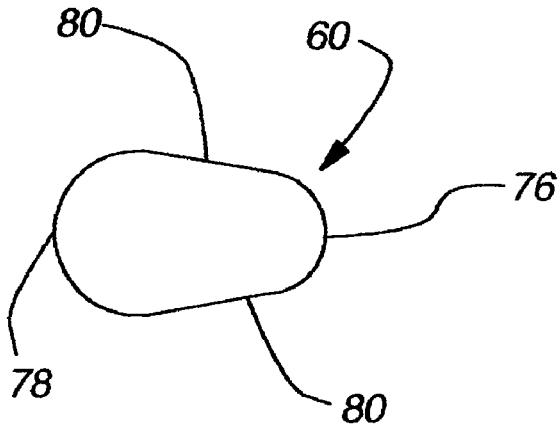
FIG. 12 is an end elevation of the cam shown in FIG. 11.
Figure 11:
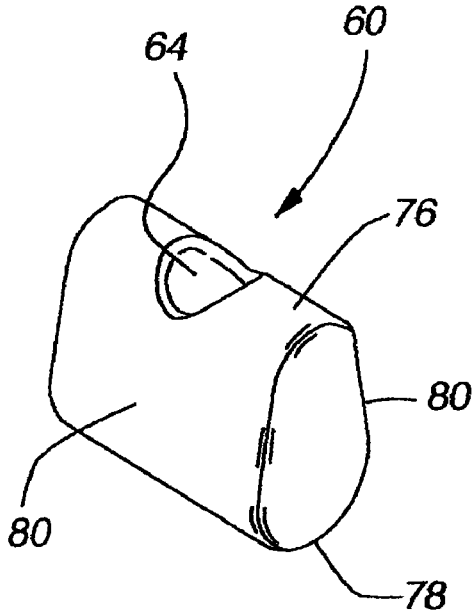
FIG. 11 is an isometric of the cam member of the anchor shown in FIG. 7.

The first embodiment of the anchor of the present invention is possibly best appreciated by reference to FIG. 7 where it can be seen to include a base member 58 and a cam member 60 each of which has a passage 62, 64, respectively, therethrough for receipt of a lift cord 48 which can then be knotted as at 66 on its bottom end. The base member 58 can be seen best in FIGS. 8-10 to comprise a main body 68 of inverted U-shaped configuration and a pair of generally horizontally disposed flat semi-circular legs 70 projecting in diametrically opposite directions from the lower edge of the main body. The main body is made of a somewhat flexible material such as plastic, aluminum or the like and defines a downwardly opening pocket 72 between two vertical side walls 74 of the main body.

The cam member 60 seen best in FIGS. 11-14 is of generally ovular cross-section so as to have arcuate top 76 and bottom 78 surfaces with the top surface being of a smaller radius than the bottom surface. Between the top and bottom arcuate surfaces, a pair of upwardly convergent generally flat side walls 80 are defined. The dimension of the upper arcuate surface of the cam member is less than the width of the pocket 72 and is adapted to be received in the pocket. Due to the upwardly convergent and therefore downwardly divergent side walls 80, movement of the cam member upwardly into the pocket 72 spreads the side walls 74 of the main body of the base member 58 causing the semi-circular legs 70 to flare generally upwardly and outwardly to grip the wall 82 of the blind hole 52 in which the anchor is disposed.

Figure 5:
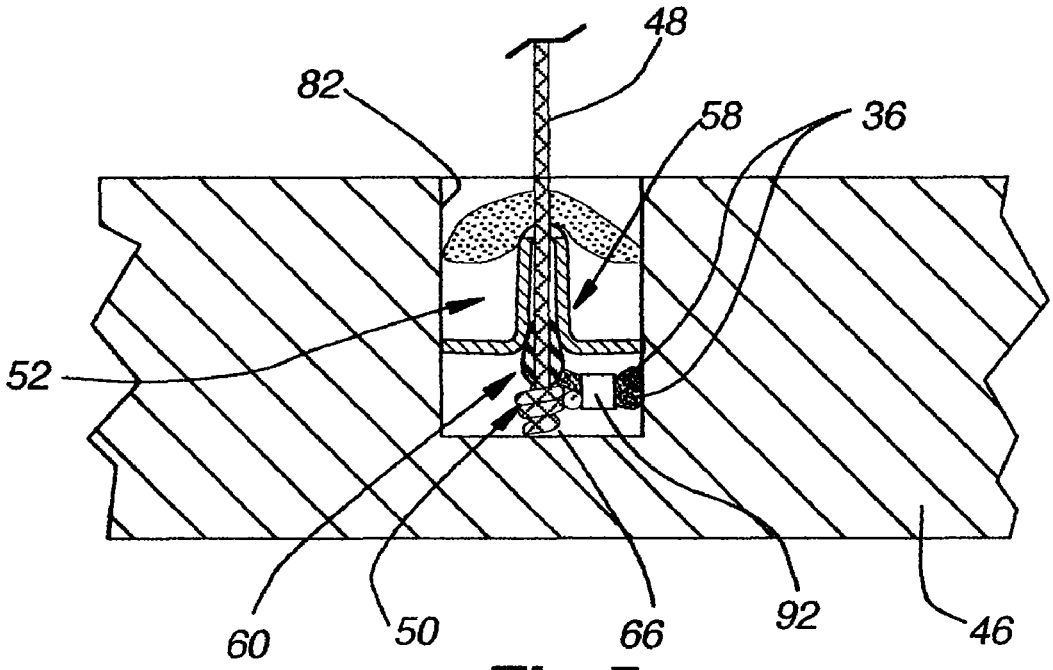
FIG. 5 is a fragmentary section taken along line 5-5 of FIG. 4.

When anchoring a lift cord 48 to the bottom rail 46, the base member 58 is first threaded onto the lower end of the lift cord and thereafter the cam member 60, and subsequently the knot at 66 is tied in the bottom of the lift cord which is larger than the passages 64, 62 through the cam member and the base member, respectively. The knot is then inserted into the blind hole 52 along with the cam member and finally the base member is inserted so that the cam member is aligned with the downwardly opening pocket 72 in the base member. With the base member and cam member fully inserted into the blind hole as probably best seen in FIG. 5, the lift cord can be pulled upwardly causing the knot to raise the cam member into caming engagement with the base member thereby spreading the legs 70 of the base member into frictional wedging relationship with the wall 82 of the blind hole. For aesthetic purposes, a dab of glue 86 can then be provided in the hole over the anchor to conceal the anchor within the blind hole as seen in FIG. 5.

Figure 4:
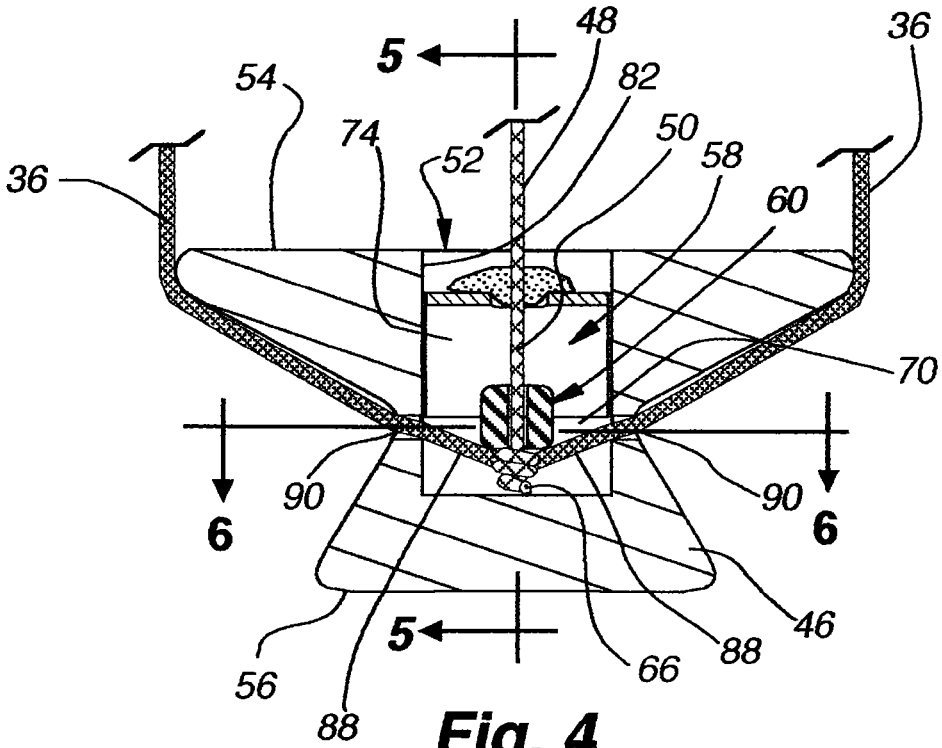
FIG. 4 is a further enlarged section taken along line 4-4 of FIG. 3.
Figure 6:
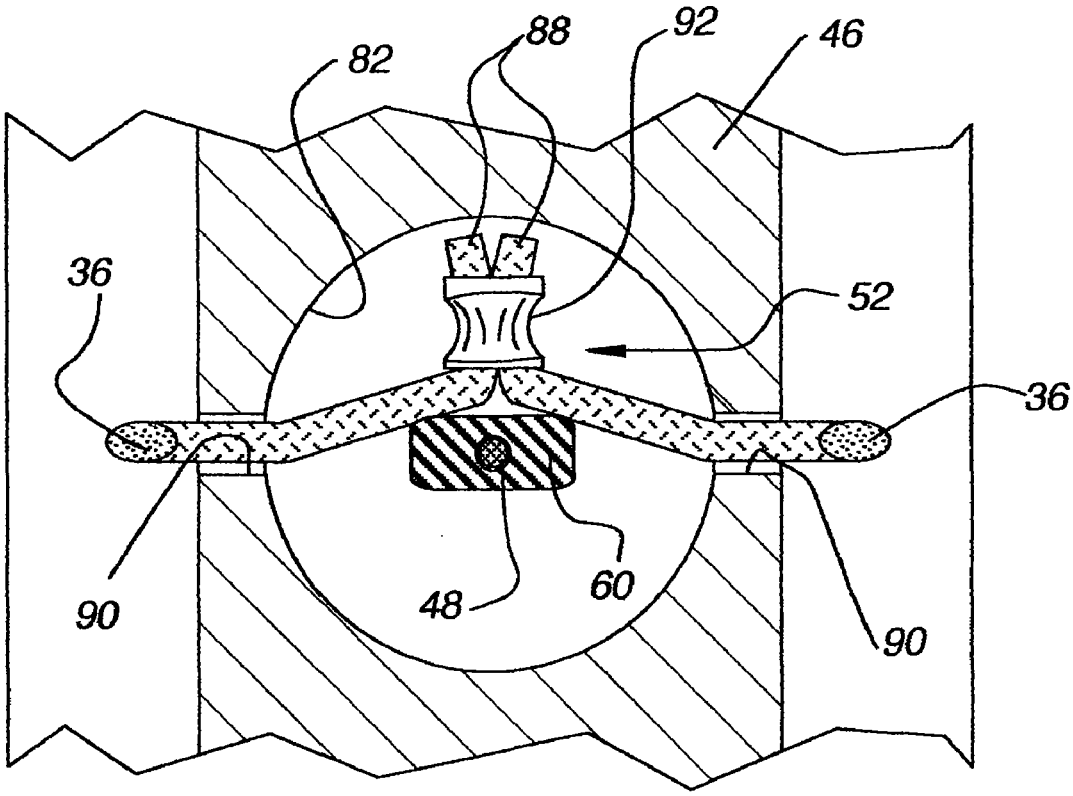
FIG. 6 is a fragmentary section taken along line 6-6 of FIG. 4.

The lower ends 88 of the front and rear vertical runs 36 of the cord ladders 34 are typically free of each other and can be secured within the bottom rail 46 by inserting each run through a corresponding front or rear passage 90 in the bottom rail that communicates with the blind hole 52 as seen in FIG. 4. The lower ends 88 of the front and rear runs of the cord ladders can then be tied into a knot and stuffed into the blind hole before the anchor so the knotted or otherwise interconnected ends of the front and rear runs of the cord ladder are confined and hidden within the blind hole. Another common way of connecting the lower ends of the front and rear runs of the cord ladder is by crimping the ends together with a compressible clamp 92 in a conventional manner as can be seen in FIGS. 5 and 6.

Figure 15:
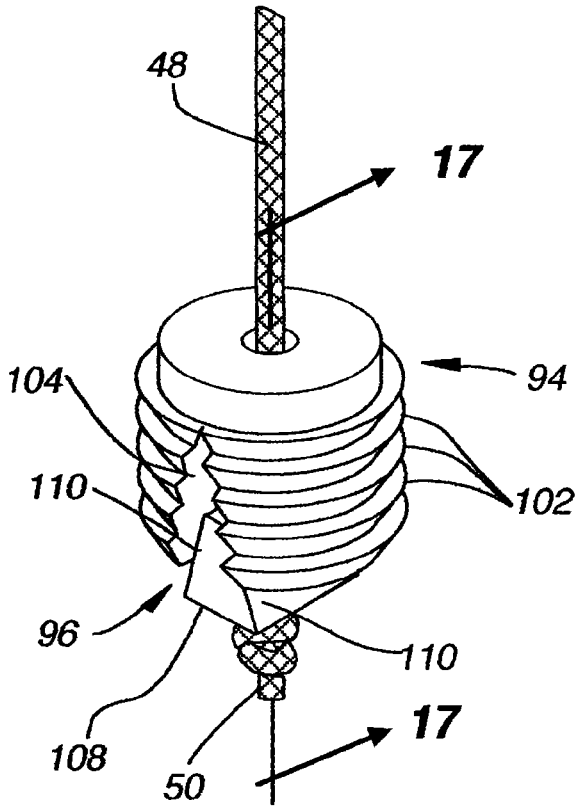
FIG. 15 is a fragmentary isometric of a second embodiment of the anchor of the present invention shown mounted on a lift cord.
Figure 16:
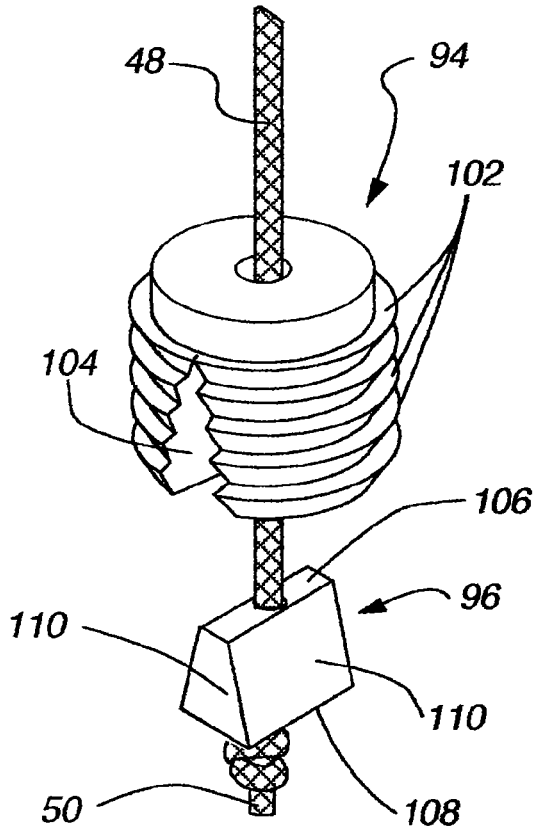
FIG. 16 is an isometric similar to FIG. 15 with the base and cam members of the anchor separated on the lift cord.
Figure 17:
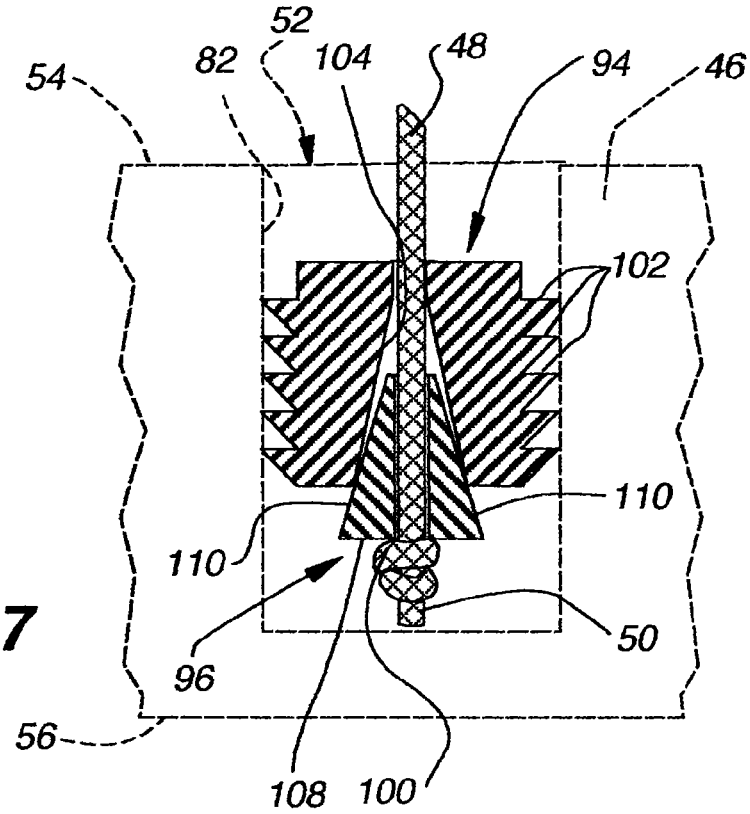
FIG. 17 is a fragmentary section taken along line 17-17 of FIG. 15.

A first alternative to the anchor described in connection with FIGS. 1-14 is seen in FIGS. 15-17. In this embodiment of the anchor, it can again be seen to include a base member 94 and a cam member 96 which are threaded onto the bottom end of the lift cord 48 as with the first-described embodiment and maintained thereon by knotting the bottom end of the lift cord at 100. In this embodiment, the base member has a generally cylindrical body 98 having a plurality of vertically spaced relatively sharp-edged rings or circumferential ribs 102 projecting outwardly therefrom with the ribs being adapted to be engaged with the side wall 82 of the blind hole 52 in which the anchor is positioned. The main body has a transverse downwardly opening notch 104 formed in the bottom thereof and the base member is made of a somewhat pliant or flexible material. The cam member 96 is generally trapezoidal in transverse cross-section so as to have a relatively narrow rectangular top surface 106 and a wider rectangular bottom surface 108 defining upwardly convergent or downwardly divergent side walls 110. In operation, the knot 100 is first stuffed into the blind hole and subsequently the cam member 96. Finally the base member 94 is positioned over the cam member so the cam member is aligned with the transverse notch 104 in the bottom of the base member. By pulling upwardly on the lift cord, the knot raises the cam member further into the notch in the base member as shown in FIG. 17 thereby spreading or expanding the base member enough so that the circumferential rings 102 engage and become wedged in the side wall 82 of the blind hole 52.

Figure 18:
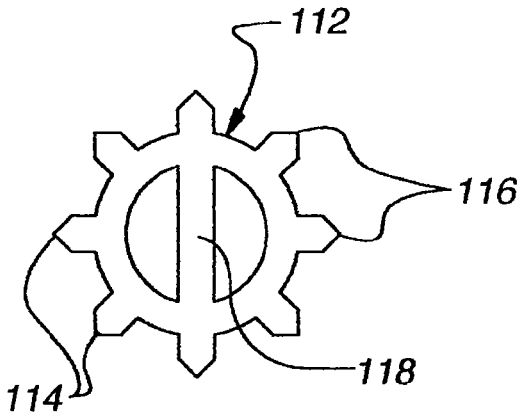
FIG. 18 is a top plan view of a third embodiment of the anchor of the present invention.
Figure 19:
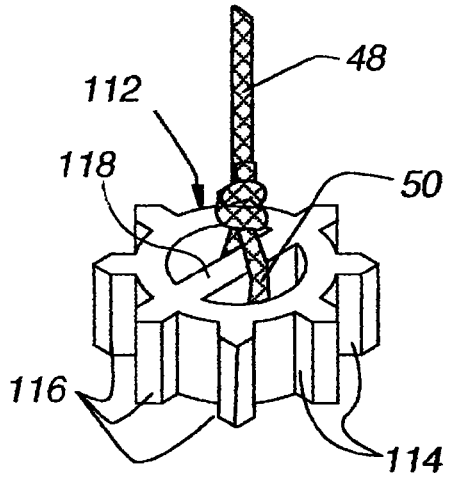
FIG. 19 is an isometric of the anchor shown in FIG. 18 connected to a lift cord.
Figure 20:
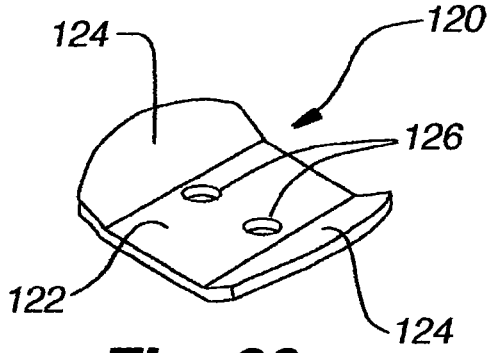
FIG. 20 is an isometric of a fourth embodiment of an anchor in accordance with the present invention.
Figure 21:
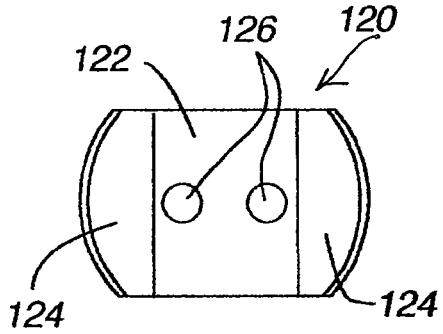
FIG. 21 is a top plan view of the anchor shown in FIG. 20.
Figure 22:
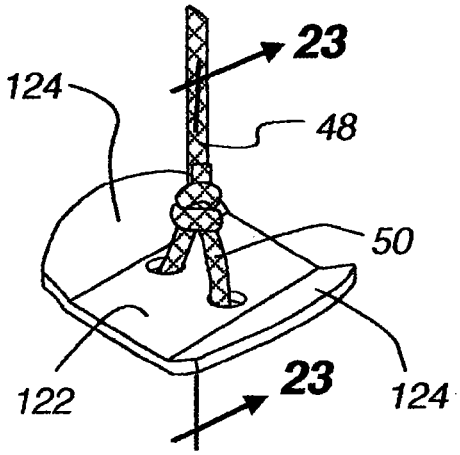
FIG. 22 is an isometric similar to FIG. 20 showing the anchor connected to a lift cord.
Figure 23:
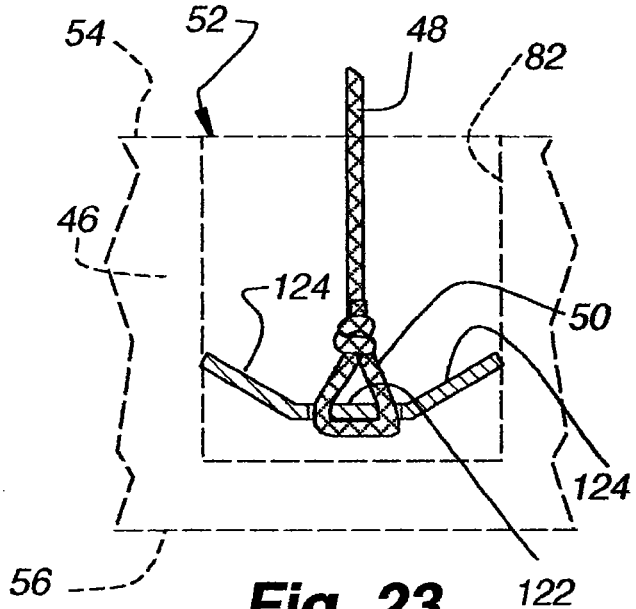
FIG. 23 is an enlarged fragmentary section taken along line 23-23 of FIG. 22.

A third embodiment of the anchor of the present invention is shown in FIGS. 18 and 19 with this embodiment being a single piece anchor. The anchor has a main body 112 with radiating fingers 114 with the main body being of generally circular horizontal cross-section and the fingers radiating therefrom in equal spacing from each other. Each finger has a vertical sharpened outer edge 116. A diametric cross-brace member 118 extends across a circular opening in the main body so that the bottom end of a lift cord 48 can be tied thereto as shown in FIG. 19. The anchor can be of any suitable depth but the diameter or width of the anchor is preferably slightly greater than the diameter of the blind hole 52 so that it can be forced or wedgingly pressed into the blind hole with the sharp vertical outer edges 116 of the fingers engaging and possibly even being embedded in the wall 82 of the blind hole depending on the softness of the material from which the bottom rail is made.

A fourth embodiment of the anchor of the present invention is shown in FIGS. 20-23 where the anchor can be seen to be a single piece 120 of plate-like semi-rigid or somewhat pliant material having a flat intermediate body 122 and a pair of arcuate outwardly and upwardly flaring side legs 124. The intermediate portion includes a pair of holes or passages 126 through which a lift cord 48 can be passed and knotted to secure the lower end of the lift cord to the anchor. When using the anchor, the lift cord is tied to the intermediate portion of the anchor and the anchor is forced downwardly into the blind hole 52. The legs 124 might even flex a little upwardly from their normal disposition shown in FIG. 20 to that of FIG. 23. The anchor is then firmly wedged within the blind hole with the outer edges of the legs being wedged and frictionally engaged with the side wall of the blind hole or even possibly partially embedded therein again depending upon the softness of the material from which the bottom rail is made.

Figure 24:
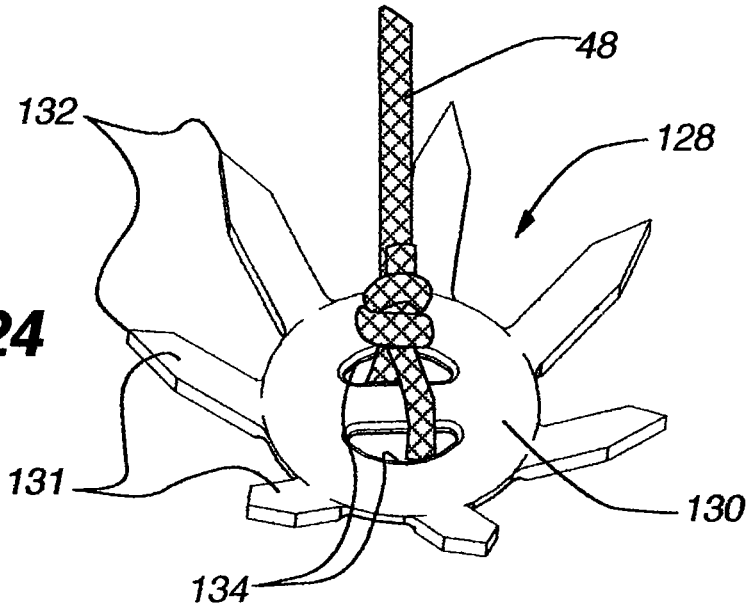
FIG. 24 is an isometric of a fifth embodiment of the anchor of the present invention with a lift cord secured thereto.
Figure 25:
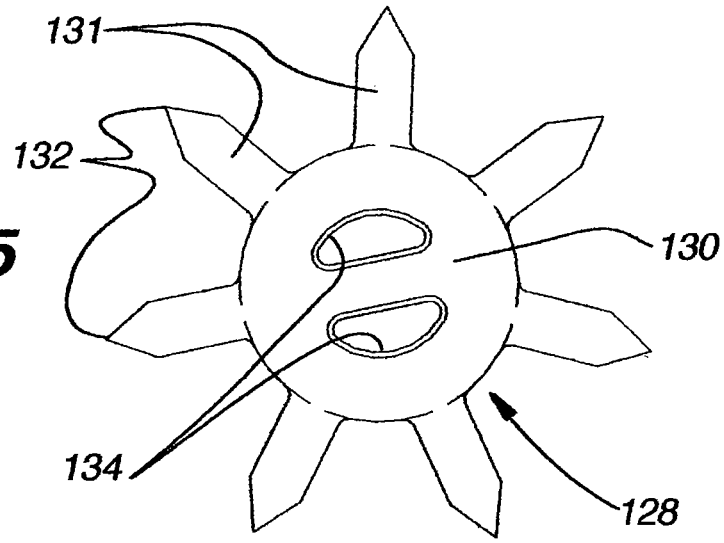
FIG. 25 is a top plan view of the anchor of FIG. 24 with the lift cord removed.
Figure 26:
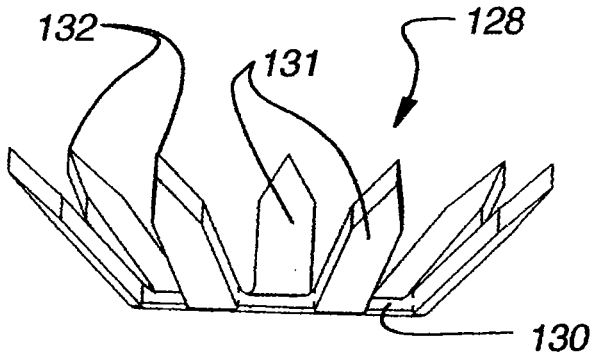
FIG. 26 is a side elevation of the anchor of FIG. 24 with the lift cord removed.

A fifth embodiment of the anchor of the present invention is shown in FIGS. 24-26 where the anchor can be seen to be a single piece 128 of plate like semi rigid or somewhat pliant material having a flat intermediate body 130 and a plurality (in the disclosed embodiment 7) of outwardly and upwardly radiating fingers 131 having pointed or sharpened outer tips 132. The fingers preferably form an obtuse angle to the intermediate body 128 The intermediate portion includes a pair of holes 134 through which a lift cord 48 can be passed and knotted to secure the lower end of the lift cord to the anchor. When using the anchor, the lift cord is tied to the intermediate portion of the anchor and the anchor is forced downwardly into the blind hole 52 of the bottom rail. The fingers 131 might even flex a little upwardly from their normal disposition shown in the drawings. The anchor is then firmly wedged within the blind hole with the outer pointed ends 132 of the fingers 131 being wedged and frictionally engaged with the side wall of the blind hole or even possibly partially embedded therein, again depending upon the softness of the material from which the bottom rail is made.

Pursuant to the above, an anchor for securing the lower end of a lift cord to the bottom rail of a covering for architectural openings has been described in several embodiments, each of which is adapted to be wedgingly engaged with the wall of a blind hole in the top surface of the bottom rail of the covering. It will be appreciated the anchor is most suitable for use with bottom rails made of relatively soft materials such as wood but can also be useful in materials which are hard relative to wood as the anchors are wedged into the hole and not easily dislodged therefrom. The anchors themselves can be made of any suitable material such as plastics, metal or the like consistent with the functioning characteristics of the anchor described above.

Although the present invention has been described with a certain degree of particularity, it is understood the present disclosure has been made by way of example and changes in details or structure may be made without departing from the spirit of the invention as defined in the appended claims.

The invention claimed is:

1. A covering for an architectural opening comprising in combination:

a retractable cover including a bottom rail with a top surface, and a control system for moving the cover between extended and retracted positions, said control system including flexible lift elements secured to said bottom rail for raising and lowering said bottom rail when moving the cover between said retracted and extended positions, wherein said bottom rail has at least one blind hole in said top surface having a surrounding wall and an anchor in said blind hole connected to a flexible lift element to secure the lift element in the blind hole in the bottom rail, said anchor including a semi-rigid, expandable base member and a cam member movable into engagement with said base member to expand the base member into gripping engagement with said surrounding wall, said flexible lift element extending slidably through said base member and supporting said cam member by itself such that said lift element can raise said cam element into expanding engagement with said base member, said base member being made from a flexible material having an inverted U-shaped configuration with a pair of spaced side walls defining a pocket therebetween to receive said cam member and a pair of flat semi-circular legs projecting in diametrically opposite directions from the lower edges of said side walls.

2. The covering of claim 1 wherein said bottom rail is made of wood.

3. The covering of claim 1 wherein said legs project substantially perpendicularly from said side walls.

4. The covering of claim 3 wherein said side walls are flat and parallel with each other.

5. The covering of claim 1 wherein said main body portion includes a passage therethrough and wherein said lift cord extends through said passage and is secured to said cam member whereby an upward pull on said lift cord will set said cam member in said pocket and bias said legs into engagement with said wall.

6. The covering of claim 5 wherein said hole is a blind hole.

* * * * *